United States Patent [19]

Nitschmann

[11] Patent Number: 5,042,350

[45] Date of Patent: Aug. 27, 1991

[54] SAW CHAIN FOR A MOTOR-DRIVEN CHAIN SAW

[75] Inventor: Karl Nitschmann, Schorndorf, Fed. Rep. of Germany

[73] Assignee: Andreas Stihl, Waiblingen, Fed. Rep. of Germany

[21] Appl. No.: 403,134

[22] Filed: Sep. 5, 1989

[30] Foreign Application Priority Data

Sep. 3, 1988 [DE] Fed. Rep. of Germany ..... 3830025

[51] Int. Cl.[5] ..... B27B 33/14

[52] U.S. Cl. ..... 83/522.11; 83/830; 83/834

[58] Field of Search ..... 83/830–834, 83/DIG. 1, 522.11; 30/383–387

[56] References Cited

U.S. PATENT DOCUMENTS

| | | | |
|---|---|---|---|
| 2,852,048 | 9/1958 | Cox | 83/831 |
| 4,409,874 | 10/1983 | Nitschmann et al. | 83/833 |
| 4,430,795 | 2/1984 | Wetzel et al. | 83/831 X |
| 4,459,890 | 7/1984 | Dolata et al. | 83/834 |
| 4,604,932 | 8/1986 | Doiron | 83/830 |
| 4,643,065 | 2/1987 | MacGavin | 83/830 |

*Primary Examiner*—Frank T. Yost
*Assistant Examiner*—Eugenia A. Jones
*Attorney, Agent, or Firm*—Walter Ottesen

[57] ABSTRACT

The invention is directed to a saw chain for a motor-driven chain saw equipped with a guide bar and a drive motor for imparting a force to the saw chain for moving the latter around the guide bar in a predetermined direction. The saw chain includes: a plurality of cutting links, a plurality of driving links and a plurality of connecting links, the links being pivotally interconnected by rivets or the like to define the saw chain. The cutting links have respective cutting teeth disposed at a pregiven elevation above the guide bar. A plurality of non-cutting riders are mounted on selected ones of the links so as to be at an elevation corresponding approximately to the elevation of the cutting teeth for visibly marking the movement of the saw chain around the guide bar.

66 Claims, 5 Drawing Sheets

SAW CHAIN FOR A MOTOR-DRIVEN CHAIN SAW

FIELD OF THE INVENTION

The invention relates to a saw chain for a motor-driven chain saw equipped with a guide bar and a drive motor for imparting a force to the saw chain for moving the latter around the guide bar. The saw chain includes cutting links, drive links and connecting links all pivotally interconnected by rivets or the like to define the saw chain. The cutting links are each provided with a depth limiter or a separate link performing this function.

BACKGROUND OF THE INVENTION

Saw chains of this kind are utilized in so-called professional motor-driven chain saws which are operated by experienced personnel such as expert woodworkers, timberjacks or the like. Saw chains are also used in motor-driven chain saws for hobbyists and generally by non-professional persons for various woodcutting operations. It has been shown that non-professional persons are relatively careless when working with motor-driven chain saws because many such persons do not recognize or underestimate the danger of injury which is present because of the rapid movement of the saw chain around the guide bar.

SUMMARY OF THE INVENTION

In view of the foregoing, it is an object of the invention to provide a saw chain equipped with an arrangement which gives the operator a visible and clear signal when the saw chain is driven so that it moves around the guide bar. On the one hand, the operator is made aware of the danger which exists with the movement of the saw chain about the guide bar and, on the other hand, the arrangement at the same time provides a certain protection against contacting the rapidly moving saw chain. A further object of the invention which is independent of the above-mentioned object but augments the same is to configure the arrangement providing the warning and contact protection such that the functional performance of the saw chain can be favorably influenced, for example, its running performance and/or its performance during the cutting operation.

The saw chain of the invention is for a motor-driven chain saw equipped with a guide bar and a drive motor for imparting a force to the saw chain for moving the latter around the guide bar in a predetermined direction. The saw chain includes: a plurality of cutting links, a plurality of driving links and a plurality of connecting links, the links being pivotally interconnected by rivets or the like to define the saw chain; the cutting links having respective cutting teeth disposed at a pregiven elevation above the guide bar; and, a plurality of non-cutting riders mounted on selected ones of the links so as to be at an elevation corresponding approximately to the elevation of the cutting teeth for visibly marking the movement of the saw chain around the guide bar.

The non-cutting riders are tightly connected with links of the saw chain in a suitable manner such as by welding, cementing, by specially configured form-tight holding means, clamping or the like. As a consequence of the non-cutting riders, the saw chain is provided with a kind of signal or warning means which clearly indicates that the saw chain is in a rapid movement around the guide bar and therefore the motor-driven chain saw as a unit is to be handled with caution. This signal or warning means is a clear indication especially for inexperienced operators.

The signal action then provides a clear indication of the rapid movement of the saw chain around the guide bar during the operation of the motor-driven chain saw. Such a signal effect is also achieved when the riders are so configured that they are arranged as intermediate links directly in the interconnected links of the saw chain such as between two cutting links or if they are arranged on intermediate links which already exist. Such a signal action is achieved especially when the riders are provided with appropriate notable markings which can be achieved, for example, by utilizing plastic as the material for the riders and by appropriately dyeing the plastic to have a suitable color.

A certain touch protection is simultaneously provided when the riders are arranged at the same elevation as the cutting teeth of the cutting links. This contact protection can be increased if the riders have an especially configured movable part which projects above the cutting links during the movement of the saw chain and if this movable part is provided to have such a movability that it moves into a position wherein it does not influence the actual cutting operation, that is, when the cutting edges of the cutting links are in engagement with the wood.

Individual parts of the riders reach up to the cutting teeth and preferably terminate above the cutting teeth during the movement of the saw chain. Because of this condition, these parts provide an especially clear optical indication during movement of the saw chain. In the event that the operator places, for example, the hand close to the rapidly moving saw chain, a contact protection is achieved in that the operator first comes into contact with the non-cutting parts which project upwardly beyond the cutting links and/or depth limiter links thereby making the operator urgently aware of the existing danger. This is achieved especially if the riders are color-marked, for example, with red, blue or similar signal color so that a colored band is traced during the movement of the saw chain thereby providing a clear indication of the danger zone of the saw chain.

According to a feature of one embodiment of the invention, the movable part of the rider is configured as a preferably elastic lever arm which extends in a direction opposite to the direction of movement of the saw chain. This lever arm is freely movable and preferably extends to just ahead of the cutting link and in a saw chain wherein the cutting links are provided with depth limiters, the arm extends up to directly ahead of the corresponding depth limiter. The rider includes an attachment part whereat the other end of the longitudinally extending lever arm is connected. With this attachment part, the rider is, as a unit, securely attached to the particular chain link either in a non-detachable manner such as by welding, cementing or the like or is detachably connected by form-tight means such as snap-in means or clip-in means or held under its own tension.

According to a second embodiment of the rider, the latter is configured as a bow having two attachment portions which are disposed in spaced relationship to each other and between which the movable part of the rider extends. The movable part can be configured as a resilient bow, for example. It is then advantageous if the movable part is made out of an elastic and especially a resilient material. This elastic material can be a suitable plastic, spring steel or the like. Snap closures or press fasteners can also be used to attach the riders and which coact with corresponding attachment parts provided in the particular chain links. According to another feature of the invention, a combination of different attachment means and/or the combination of differently configured riders is conceivable in a chain of links for the saw chain. The subject matter of the invention with respect to its elements and their combination is also applicable for other motor-driven handheld portable cutting tools such as for brushcutters.

BRIEF DESCRIPTION OF THE DRAWINGS

The invention will now be described with reference to the drawings wherein.

DESCRIPTION OF THE PREFERRED EMBODIMENTS OF THE INVENTION

Figure 3:
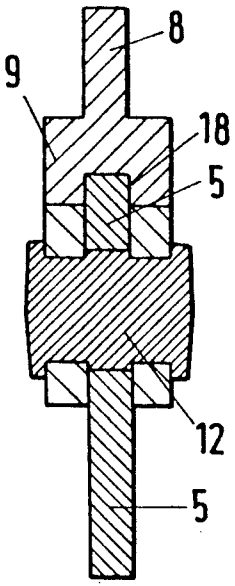
FIG. 3 is a section view taken along line III—III of FIG. 1.

The saw chain 1 shown in the various embodiments of the drawings comprises a chain connection of individual chain links such as cutting links 2, drive links 5 and connecting links 4. These chain links (2, 4, 5) are pivotally connected with each other by means of rivets or pins 12. The drive links 5 have downwardly extending portions known as so-called rakers 5' which come into contact engagement with a drive sprocket (not shown) and which run in the guide groove of the guide bar 22 during movement of the chain around the guide bar. The cutting links 2 are provided with depth limiters 3 in the embodiments shown. These depth limiters 3 can also be configured as links separate from the cutting links. The embodiments of the invention described herein can also find application in other cutting tools such as in rotating cutting tools for brush cutters.

According to the invention, at least some of the cutting links are provided with non-cutting riders 7 which lie approximately at the elevation of the cutting links 2 and visibly and distinctly mark the movement of the saw chain during its movement around the guide bar. The riders can also be provided with a special marking color or can already be appropriately dyed for configurations wherein the riders are made of plastic. In this way, a colored marking band is provided during movement of the saw chain 1 which moves continuously in the direction of movement F around the guide bar. This marking band is set off significantly from the actual cutting links and provides indication to the operating person of the rapid movement of the chain with its cutting links 2. The riders can have any suitable geometric form. They can also be integrated directly into the existing chain of connected links. For example, this can be achieved in a chain link connection incorporating safety links, the latter themselves or portions thereof can be provided with markings and in this way be configured as rider elements in the spirit of the invention. The safety links are arranged ahead of the depth limiters or cutting links when viewed in the direction of movement of the saw chain around the guide bar.

In an especially advantageous embodiment of the invention, the riders 7 are provided with projections 8 which extend rearwardly in the longitudinal direction of the chain viewed in the direction of movement F of the chain 1. The projection 8 is arranged directly ahead of the cutting links 2 and for chains without depth limiters the projections 8 are arranged directly ahead of the cutting edge 6 of each cutting link or they can end behind the cutting edge 6. For chains whose cutting links are provided with depth limiters, these longitudinally extending projections 8 of the riders 7 can extend up to the immediate proximity of the depth limiters 3.

Thus, projections 8 extend rearwardly during the direction of movement F of the chain 1 around the guide bar such that they extend directly to the depth limiters 3 or beyond the latter and up to the elevation of the depth limiter 3 or of the cutting edge 6 and preferably above the elevation of the depth limiter or cutting edge 6. Because of the foregoing, the riders are at the same time a protection against touching or contact and provide a warning. The projections 8 constitute a warning because they are distinctly offset from the chain and extend in the longitudinal direction. The projections 8 are protective because, for example, the hand of the operator of the chain saw first comes into contact with the projections 8 which stand so as to be above the chain per se and in this way warn of an imminent danger of direct contact with the chain itself.

In order that the contact protection does not affect the cutting performance of the saw chain 1, it is a feature of the invention that the elongated portions 8 of the riders 7 which stretch rearwardly are configured as movable parts 8 such that these parts have a movability which is perpendicular to the direction of movement F of the chain. This permits the parts 8 to move into a position during the cutting action of the cutting links which is lower, at most however at the same elevation as the cutting edge 6 of the cutting links 2 or of the depth limiters 3.

For the above purpose, the riders 7 are elastically configured at least insofar as the movable part 8 such that this movable part is movable downwardly toward the rivets 12 when entering a kerf and after leaving the kerf, they move into their initial position by means of their intrinsic elasticity. This is possible in that at least these movable parts of the riders 7 are made of a suitable elastic material which is preferably resilient such as spring steel, elastic plastic or the like. Embodiments are conceivable wherein the riders themselves are rigid and movably attached to links of the saw chain. Also, an embodiment is conceivable wherein the movable parts 8 of the riders 7 are themselves configured so as to be so non-rigid that they have no shape stability of their own and simply extend longitudinally under the action of the centrifugal force developed during movement of the saw chain around the guide bar.

Figure 12:
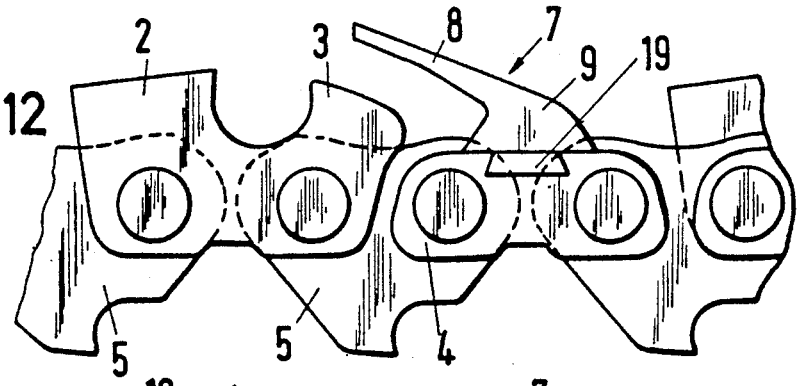
FIG. 12 is an embodiment similar to that of FIG. 1 but with the movable portion of the rider projecting into the region of the depth limiter directly behind the rider viewed in the direction of movement of the saw chain with the movable part of the rider being configured so that it lies parallel to the depth limiter during a cutting operation.
Figure 13:
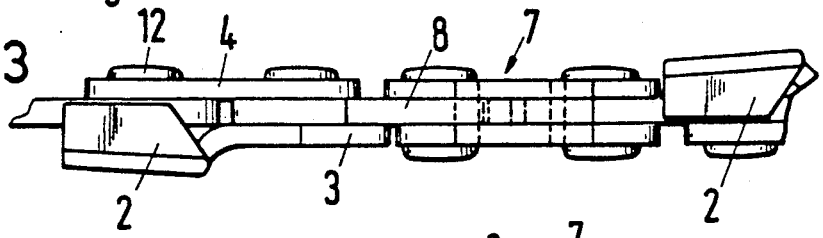
FIG. 13 is a plan view of the cutaway portion of the saw chain of FIG. 12.

As the embodiments show, the riders 7 have an attachment part 9 in addition to the resilient part 8 which extends rearwardly and is movable in elevation. With the attachment part 9, the riders 7 can be attached to the chain links, such as the connecting links 4, drive links 5 or to the cutting links 2. The riders 7 then comprise the attachment part 9 and the resiliently movable part 8. The riders 7 are advantageously configured that the movable part 8 defines a lever arm 11 which is movable in elevation and extends unencumbered rearwardly from the attachment part 9 as shown, for example, in FIG. 1. The width of this lever arm is less than the cutting width of the cutting edge 6 so that the movable part 8 always lies within the kerf to be cut as can be seen, for example, in FIG. 2. The elongated extension of the part 8 in the direction F of the saw chain can reach up to the depth limiter 3 but also can extend beyond the latter. In the last case, the movable part 8 is so arranged that it extends only at one side of the depth limiter 3 and as a consequence of its movability, extends at most to the elevation of the depth limiter during the cutting operation, preferably beneath the highest location of the depth limiter as shown in FIGS. 12 and 13.

Figure 14:
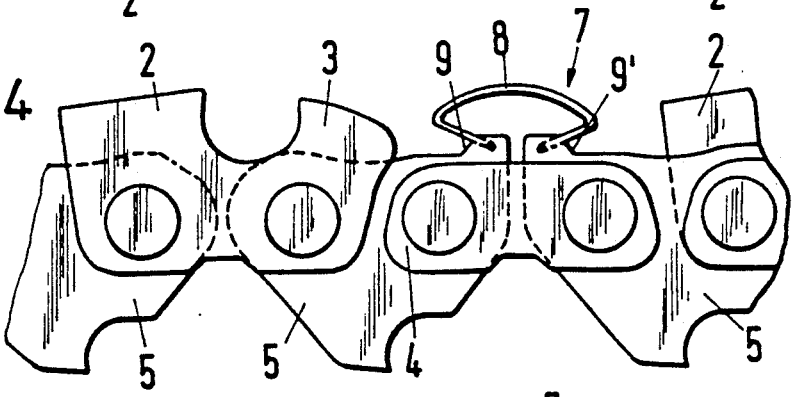
FIG. 14 is another embodiment of the rider wherein the latter is in the form of a bow.
Figure 15:
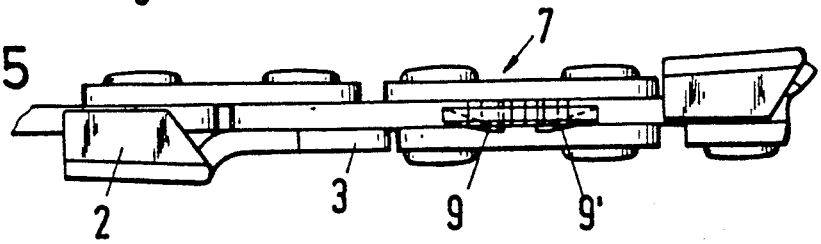
FIG. 15 is a plan view of the cutaway portion of the saw chain shown in FIG. 14.
Figure 16:
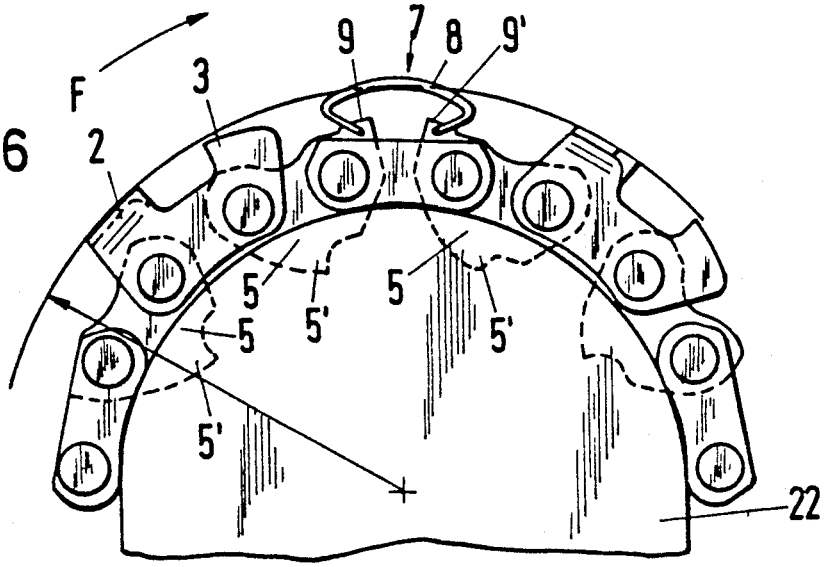
FIG. 16 is a cutaway portion of a saw chain corresponding to that shown in FIG. 14 showing the saw chain in its movement around the free end of the guide bar.

According to the invention, an embodiment is conceivable wherein the rider 7 is configured in the form of a bow having two attachment portions (9, 9') disposed at a spacing from each other as shown in FIGS. 14 to 16. The movable part 8 is provided between the two attachment portions (9, 9') as a kind of resilient bow. The rider 7 can be approximately semicircularly-shaped or C-shaped or U-shaped. The attachment parts (9, 9') for the rider 7 can also be made of non-elastic material. This can preferably then be the case when the riders are intended to prevent plunging the saw chain into wood especially in saw chains intended for the hobbyist.

The attachment parts (9, 9') can be securely connected to the links of the saw chain in a form-tight manner by means of welding, adhesive, insertion and injection molding.

Figure 19:
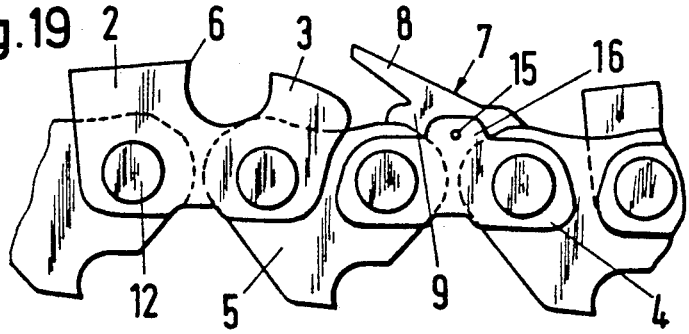
FIG. 19 shows a rider attached with rivets in a corresponding recess of a connecting link.
Figure 20:
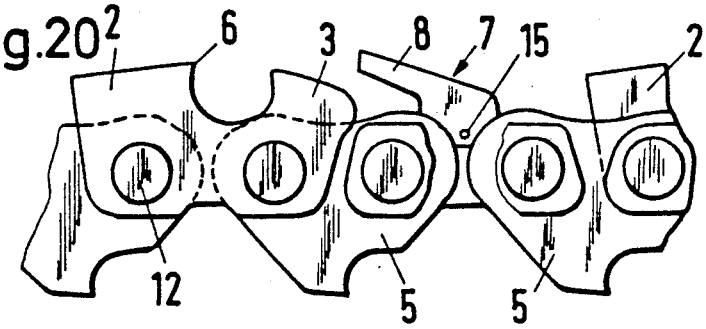
FIG. 20 shows an arrangement wherein the rider is disposed in the intermediate space between two drive links; and, FIG. 21 shows an attachment arrangement for the rider wherein the latter is clamped between two rivets of two mutually adjacent drive links and held in place under its own resilient force and is non-releasably fixed between these drive links by means of hook-like portions.

It is advantageous to provide the attachment parts 9 with attachable connectors, for example, in that the attachment parts 9 and the corresponding links such as the connecting links 4 are configured to have pins 15 and so that the latter are adapted to cutouts 16 on the connecting links as shown in FIGS. 19 and 20. In the configuration of FIG. 19, the pin 15 or the cutout 16 is provided on an upwardly extending lug of the connecting link 4. The rider 7 is provided with a cutout in a corresponding manner in which the connecting pin 15 is fitted. The reverse situation can also be accommodated wherein a pin 15 is provided on the rider which fits into a corresponding cutout 16 of the connecting link 4.

In the embodiments of FIGS. 1 to 7, 12 and 17, dovetail-shaped lugs are formed on the attachment parts 9 and corresponding cutouts are provided on the chain links such as the connecting links 4 in order to provide a form-tight connection of the riders 7 to suitable chain links, for example, connecting links 4. A reverse arrangement is also conceivable wherein the dovetail lugs are provided on the cutting links and corresponding cutouts are provided on the attachment parts 9.

Figure 8:
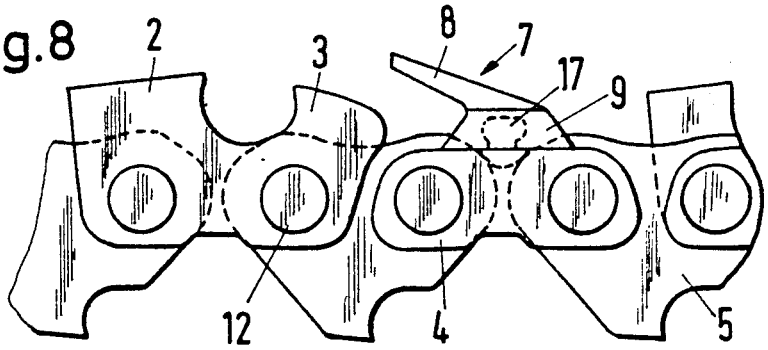
FIG. 8 is an arrangement corresponding to that of FIG. 1 wherein the rider is mounted on a center link of the saw chain.
Figure 9:
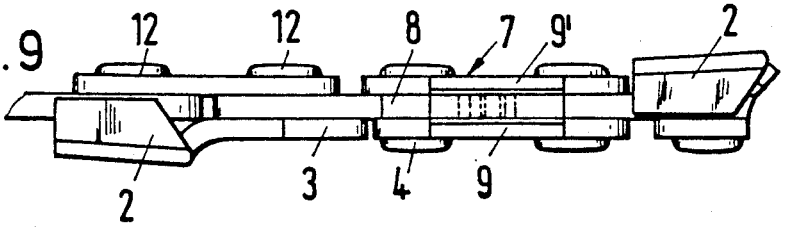
FIG. 9 is a plan view of the cutaway portion of the chain saw shown in FIG. 8.
Figure 10:
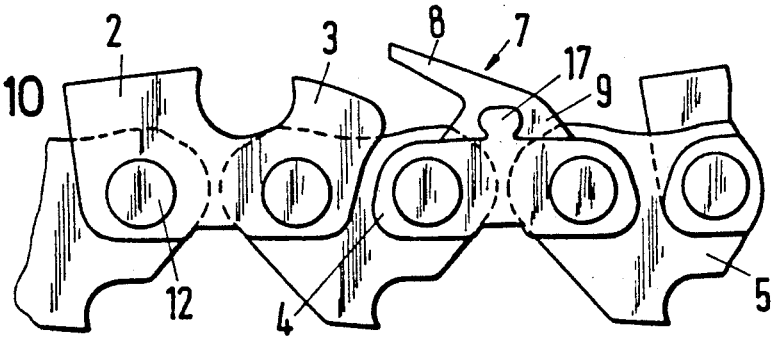
FIG. 10 is an arrangement of the rider on a connecting link lying on the outside of the saw chain.
Figure 11:
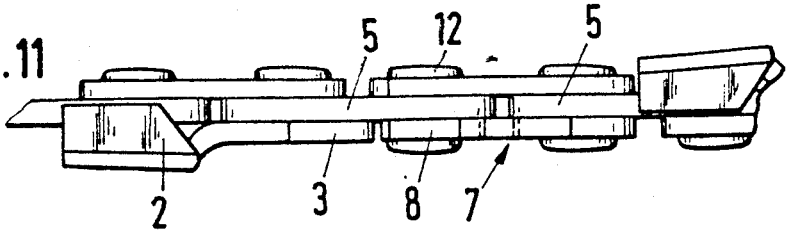
FIG. 11 is a plan view of the cutaway portion of the saw chain shown in FIG. 10.

The embodiments of FIGS. 8 to 11 show a form-tight connection wherein projecting cam-shaped lugs 17 are provided, for example, on the connecting links 4 which fit into correspondingly adapted cutouts in the attachment parts 9 of the riders 7. In the embodiment of FIG. 8, a cam-shaped lug 17 is the receiver for the attachment part 9 and is offset laterally from the connecting link 4 toward the center. This cam-shaped lug is enclosed at both sides by clip-like attachment parts (9, 9') as shown in FIG. 9.

By means of such form-tight configurations, the riders 7 are tightly connected with the corresponding chain links, especially the connecting links 4 which have corresponding configurations.

Figure 21:
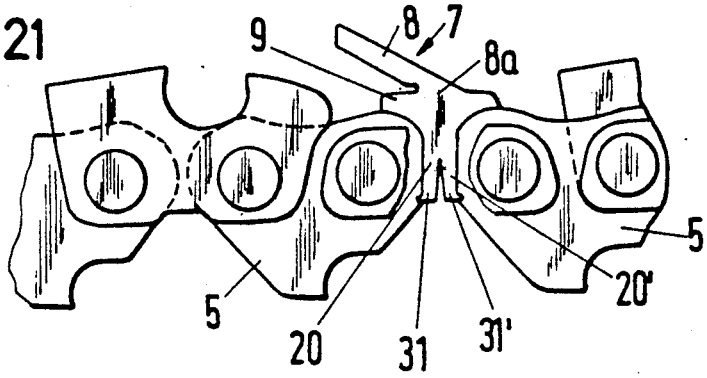

Another possibility of the connection is that the riders 7 are provided with insert parts which in turn have attachment portions which engage behind the cutting links and/or which are tightly clamped by means of their inherent force between the chain links. Such an embodiment is shown in FIG. 21 wherein the riders 7 are tightly connected to the chain links with the aid of attachment parts 9 defined as pretensioned resilient legs (20, 20'). In order to reliably prevent a detachment of the riders 7, the inserted riders 7 are inserted between the chain links and advantageously have hook-like parts (31, 31') such that these hooks (31, 31') engage in corresponding cutouts of mutually adjacent chain links. In the embodiment of FIG. 21, the attachment part 9 is snapped into place between mutually adjacent drive links (5, 5') and is further secured against loosening by the hooks (31, 31') which engage in cutouts of the flanks of the drive links (5, 5').

The embodiment of FIG. 21 is an alternative for the movable arrangement of the movable part 8. This arrangement provides for a pivot location at the transition between the movable part 8 and the attachment part 9 of the rider. This pivot location can, for example, be defined by a weakening of the transition cross section between the parts 8 and 9. This pivot location makes it possible to configure the movable part 8 either elastically and to impart a higher movability to the movable part 8 by this pivot location 8*a* or to make the part 8 out of non-elastic material so that the part 8 is brought into its lifted position by, for example, centrifugal force and, when the chain is not in operation, the part 8 drops into a lowered rest position in accordance with the configuration of the movability of this pivot location 8*a*.

The resilient parts (20, 20') are so configured that the rider 7 is pressed from above down into the gap located between the center links (5, 5') of the saw chain with the resilient legs (20, 20') being pressed together. As soon as the hook-like projections (31, 31') are tightly seated in corresponding cutouts of the center links (5, 5'), the parts (20, 20') again spread apart as a consequence of their inherent elasticity so that the rider 7 has an absolute tight seat between the center links (5, 5').

It is also possible to connect the attachment parts 9 to a chain link in the manner of a snap or press closure.

In the embodiment shown in FIG. 20, the rider 7 is arranged between two drive links (5, 5') with the attachment part 9 being provided with a pin 15 which fits into a corresponding cutout in the connecting link.

In certain cases, an embodiment of the movable part 8 can be advantageous if its width is greater than the width of the depth limiter 3. Or, the movable parts (8, 8') shown in FIGS. 6 and 7 can lie parallel and next to each other. A cutout 21 is provided between the two movable parts (8, 8') as shown in FIG. 7. If the two parts (8, 8') are defined by a single wide part, then a cutout corresponding to the cutout 21 shown in FIG. 7 is provided in that one of the two parts (8, 8') is wider. The cutout 21 makes it possible that the depth limiter 3 can pass through the two mutually parallel movable parts (8, 8') during a downward movement thereof during the cutting operation. The depth limiter can then perform its chip-limiting function without hindrance by the two movable parts (8, 8'). In this way, and for specific cases, a widening of the movable part and thereby a larger contact surface can be provided between the movable part 8 and the base of the kerf in the wood, for example, for improving the removal of chips or to provide a greater attenuation of vibrations of the saw chain during its movement about the guide bar 22 (see FIG. 5).

Figure 1:
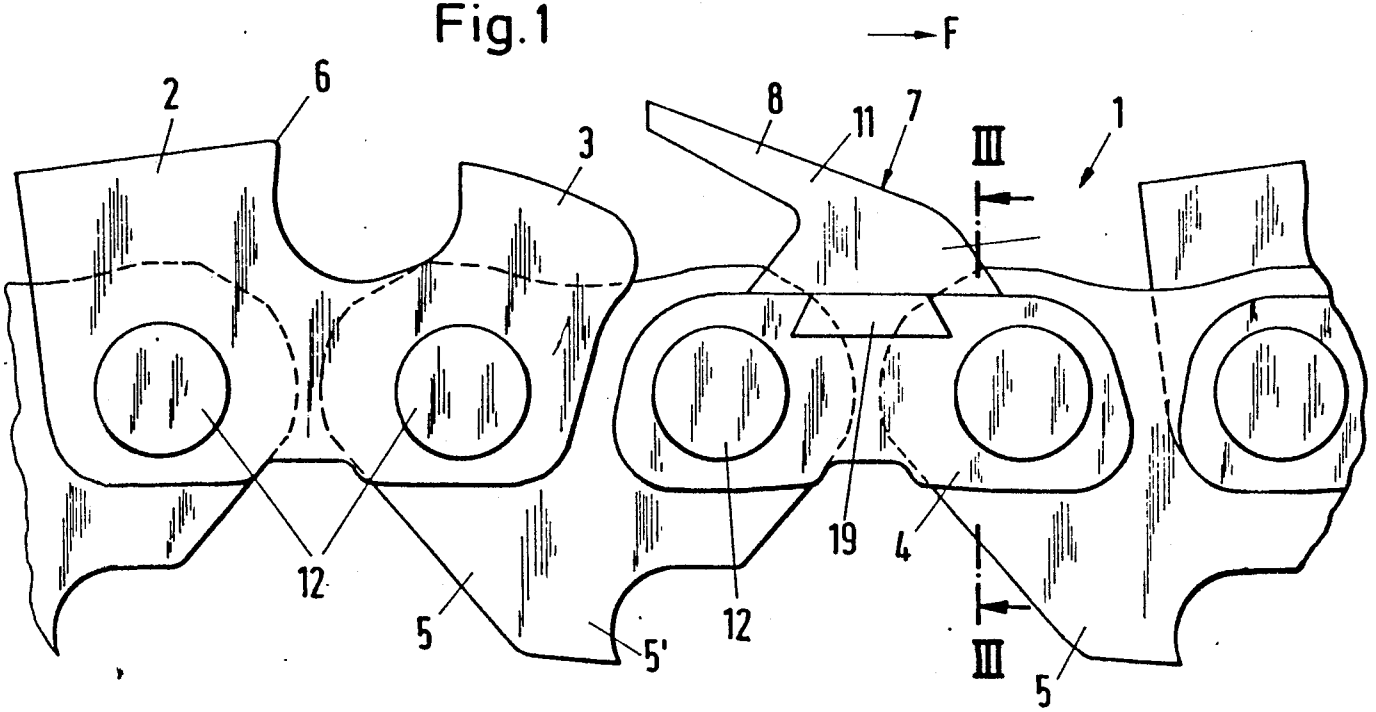
FIG. 1 is a side elevation enlarged view of a cutaway portion of a saw chain having a rider shown mounted on a connecting link of the chain with the rider being connected in a form-tight manner to the connecting link of the chain by means of a dovetail connection.
Figure 6:
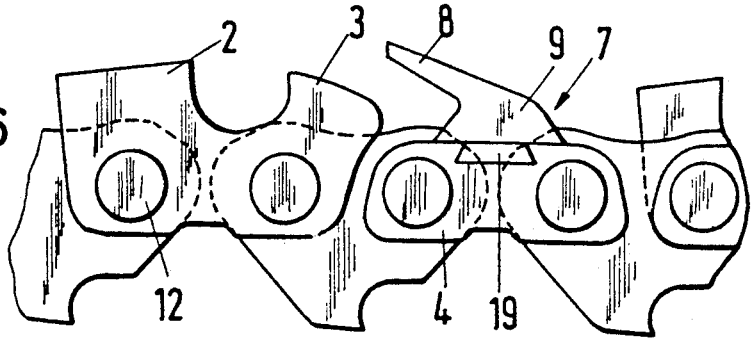
FIG. 6 is an embodiment incorporating a rider having two mutually adjacent movable parts.
Figure 7:
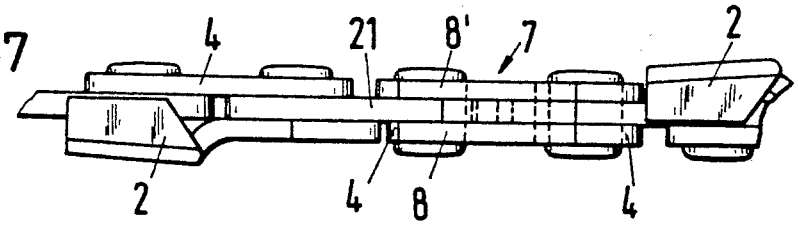
FIG. 7 is a plan view of the cutaway portion of the saw chain shown in FIG. 6.

The embodiment of FIG. 12 is similar to that of FIG. 1 and has a movable part 8 which is extended into the region of the depth limiter in such a manner that, during a cutting operation and similarly to the embodiment of FIG. 6, it lies parallel thereto but only on one side of the depth limiter (FIG. 13).

The illustrated embodiments disclose the basic inventive concept, namely: to provide riders 7 on the top side of a saw chain at one or more chain links which extend rearwardly when the chain moves about the guide bar and at least are superimposed with a portion thereof on the depth limiter or cutting link. Such a rider 7 has at least one attachment part 9 and an elastic resilient part 8 which can move out of its initial position above the depth limiter or cutting link during the actual cutting operation downwardly to a position beneath the upper regions of the depth limiter or cutting link. When leaving the kerf, the part 8 again assumes its first position at the higher elevation as a consequence of its inherent elasticity. Such a rider is preferably made of a non-metal material in order not to increase the weight of the saw chain and is preferably marked with color in order to provide a distinct optical warning against careless contact with the chain during its movement. The resilient part 8 lies against the base of the kerf during its movement about the guide bar especially during plunge-cutting operations. As a consequence of the arrangement of the resilient part 8, a loosening of the chips disposed at the base of the kerf and their removal is augmented especially by the air movement caused by the part 8.

At the same time, the configuration according to the invention affords the advantage that during movement of the saw chain, the vibrations, which always occur in the plane of the guide ban, are attenuated by a certain amount. This reduces the ringing hammer sound associated with the sound generated by individual chain links in moving about the guide bar and especially when cutting into wood with the free end of the guide bar. This also effects a compensation of the vibrations so that the movement of the saw chain in total is attenuated and quieted.

In a further embodiment of the invention, the riders 7 can be specifically configured so that they favorably influence the cut of the cutting link 2 which is directly behind the rider. For this purpose, the rider 7 can be so configured in accordance with the characteristic of the material from which it is made and its dimensions that, for example, the cutting link does not come into immediate full engagement with the wood during cutting operations such as when plunge cutting into the trunk of a tree, that is, the cutting link is prevented from immediately going to its full cutting depth. The end segment of the rider 7 is placed directly ahead of the cutting link. With this end segment, a kind of support of this end segment at the base of the kerf is provided which however is still resiliently bendable and thereby prevents a kickback-like cutting operation. This resilient bracing action can be specifically configured so that the operator first must apply a wanted pressing force which in its magnitude can at least be approximately predetermined, and with which the rearward portion or end segment of the rider is bent under the cutting edge 6 of the cutting link 2 which follows so that the cutting edge only becomes effective thereafter. With such a configuration and during a cutting operation into the wood, the operator is caused to work with an increasing force pressure until the end segment of the movable part 8 of the rider 7 has reached a position wherein it is no longer higher than the highest location of the depth limiter. Since the cutting edge of the cutting tooth does not come into engagement with the trunk of the tree immediately with this configuration (that is, it does not reach its full cutting depth), the operator can precisely determine already during the first phase of the initial cutting operation that there is first a touch contact with the wood to be cut so that by correspondingly increasing the intensity of the pressing force, the operator can smoothly introduce the actual cutting operation. Thereafter, the operator can introduce the actual cutting operation by appropriately holding the chain saw and by further increasing the pressing force. In this way, a contact or touching phase comes ahead of the actual cutting operation which makes the operator conscious of the cutting action of the cutting tools which will follow directly thereafter and so provides for a smooth start of the cutting operation.

Figure 17:
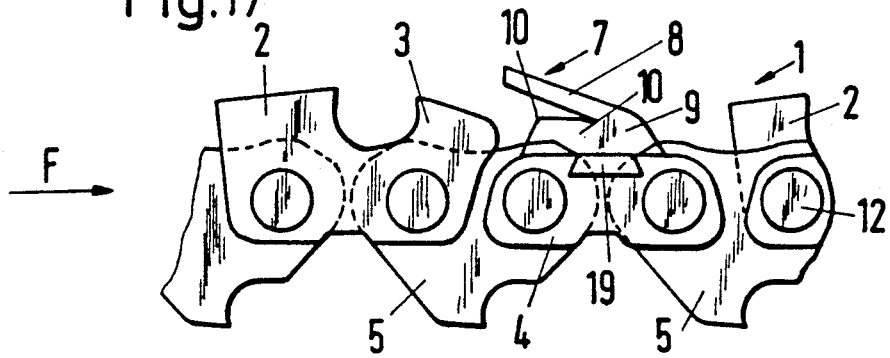
FIG. 17 is a further embodiment of the rider wherein the latter is provided with an abutment in order to limit the downward movement of the movable part thereof.
Figure 18:
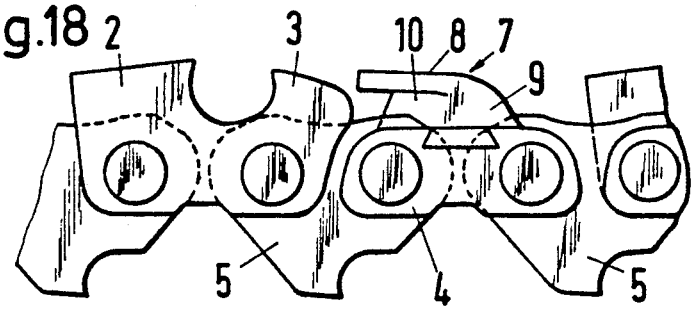
FIG. 18 shows the rider of FIG. 17 for the condition when the rider is under load and with the movable projection of the rider being in contact engagement with the abutment.

In order to achieve this advantageous effect, a further embodiment of the invention provides for an embodiment wherein the resilient downward path of the movable part 8 of the rider 7 is limited in its magnitude. According to a feature of the invention, this can be effected in that the size of the spring path and/or of the spring pressure of the movable part 8 is adapted to the magnitude of the cutting force during the cutting operation. Advantageously, the highest point of the rider 7 in the direction-reversal region of the saw chain lies higher than the depth limiter 3 and/or the cutting edge 6 of the cutting link 2 and in such a manner that when the cutting links are plunged into the wood, the cutting links 2 come into cutting engagement only after a predetermined thrust force is overcome. Preferably, the movable part 8 is provided with an abutment 10 limiting its lowest position during the cutting operation. As the embodiments of FIGS. 17 and 18 show and according to a feature of the invention, a hump-like projection 17 is formed beneath the movable part 8 in the region of the attachment part 9. It is advantageous to make the highest elevation of the abutment 10 plus the elevation of the movable part 8 lying thereupon to be less than or at most equal to the elevation of the depth limiter 3.

The abutment 10 simultaneously assures that even when an increased thrust force is applied by the operator, the movable part 8 will retain its end position during the cutting operation with the end position being defined by this abutment. This end position is at most as high as the upper portion of the depth limiter but is preferably lower than this upper portion.

Figure 2:
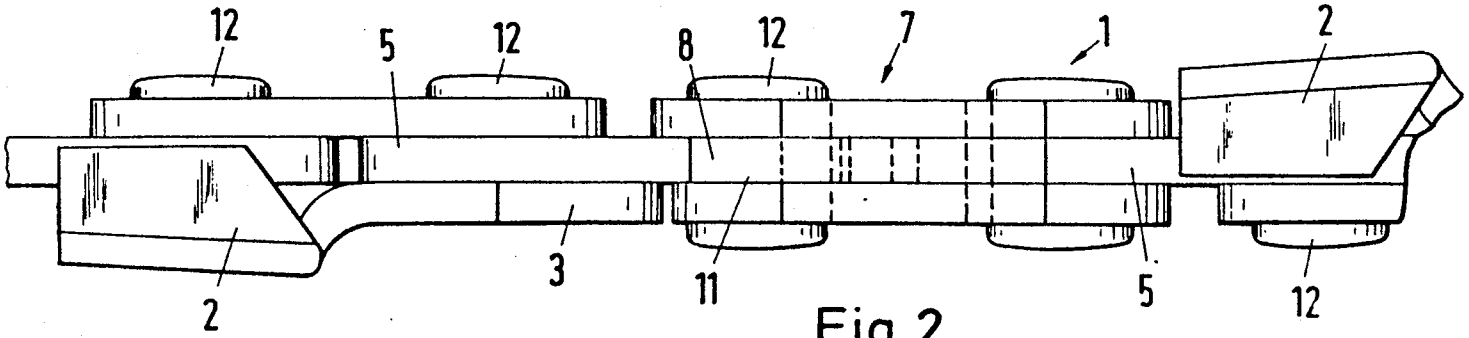
FIG. 2 is a plan view of the cutaway portion of the saw chain of FIG. 1.
Figure 4:
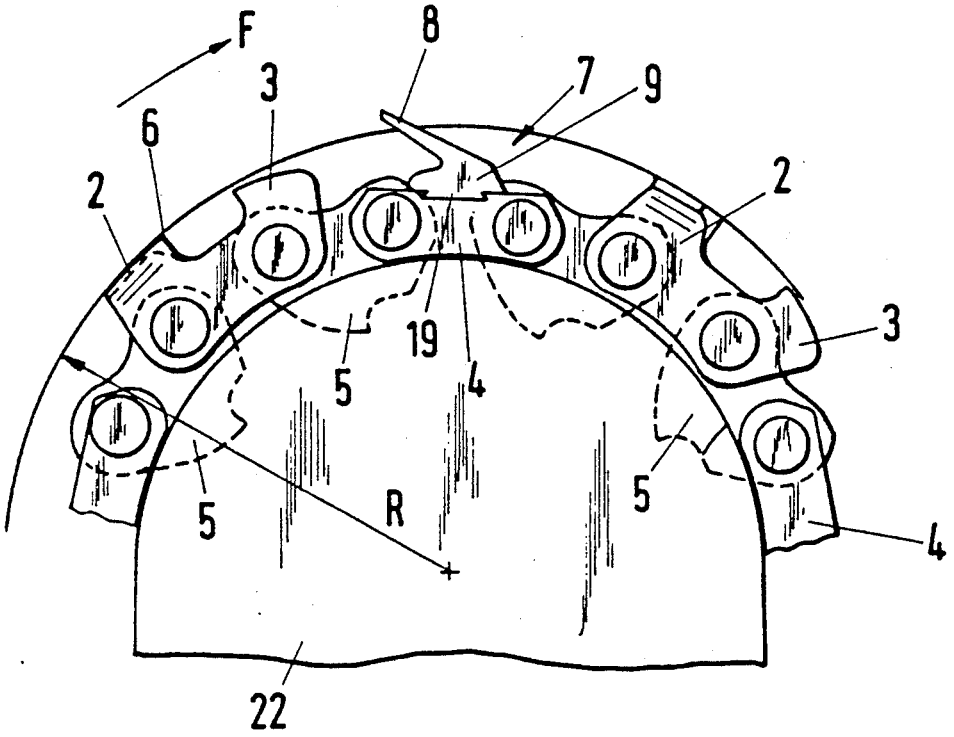
FIG. 4 is a side elevation view of the outer end of a guide bar on which a saw chain is shown in the unloaded condition, that is, without the cutting teeth being in cutting engagement with the wood to be cut.
Figure 5:
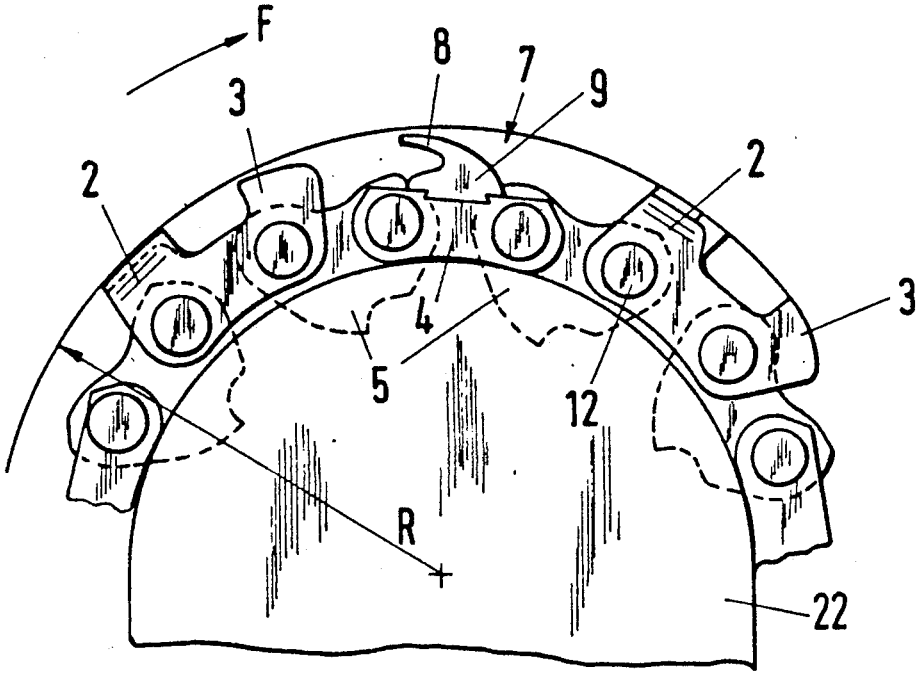
FIG. 5 is./,a side elevation view corresponding to that of FIG. 4 but with the chain under load, that is, during a plunge-cutting operation into the wood.

In the embodiments of FIGS. 6, 7 and 12, the movable part 8 was described as being with a portion of its length laterally next to the depth limiter 3 as seen in plan view. If the movable part 8 is disposed in this manner, the advantage is achieved that this end segment of the movable part 8 lying laterally next to the depth limiter 3 constitutes a kind of additional depth limiter abutment which, in addition to the actual depth limiter 3, contributes to preventing the depth limiter 3 from penetrating too deeply into the wood when an increased pressing force is applied in an undesired manner. An end segment of the movable part 8 terminating ahead of the depth limiter 3 has the same effect if the downwardly directed movement path is limited by an appropriate abutment. With the movable part 8 providing a supporting action for the depth limiter 3, the condition is prevented that the cutting tooth will cut away an undesirably thick chip thereby preventing the occurrence of known ancillary effects such as a hooking in of the saw chain as well as kickback and an uneven noisy running of the saw chain. FIG. 2 shows an embodiment wherein these advantages are obtained.

FIGS. 14 to 16 show a configuration of the rider 7 wherein the latter has the shape of a bow and is attached to the chain links, for example, the drive links (5, 5') with two attachment portions (9, 9'). This embodiment can likewise provide a limitation against too deep a penetration of the cutting links into the base of the kerf especially during plunge-cutting operations. The bow can have a specific movability which is adapted to the cutting pressure by selecting the dimensions and the elasticity of the movable part 8. The bow portion of the rider 7 shown in FIGS. 14 to 16 can have specific dimensions and an elasticity which achieve the desired movability. For example, if the movability of this part 8 is limited by a corresponding dimensioning or selection of material, then the bow-shaped part can take on a precisely defined increased pressure force and thereby prevent too deep a penetration of the cutting tooth which would otherwise lead to the undesired effects already described. In this way, a kind of safety link is provided which automatically adapts itself to the particular cutting conditions and especially during plunge-cutting operations as a consequence of its inherent elasticity and in dependence upon the thrust pressure of the operator.

According to another feature of the invention, the highest segment of the rider 7 can come to lie at an elevation greater than the highest portion of the depth limiter 3 or of the cutting edge 6 of the cutting link 2 when the saw chain is in its forward direction-reversal region. This provides that a touch or contact phase is interposed ahead of the actual chip-removal operation whereby the operator experiences a noticeable contact with the wood to be cut before the actual cutting operation begins. In this way, the operator receives a warning and can adjust to the beginning of the cutting operation by changing the thrust force as well as by increasing concentration.

The arrangement can be configured for chain saws for hobbyists so that the so-called plunge-cutting operation is completely prevented wherein the forward free end of the guide bar and the direction reversing segment of the saw chain is plunged into the wood. On the other hand, cutting into the wood in the region of the straight line portion of the guide bar for separating cuts is assured. For this purpose, a configuration is suitable wherein the bow-shaped part 8 of the rider 7 is tightly connected to chain links which are moved radially outwardly during the movement about the free end of the guide bar such that the bow moves outwardly beyond the elevation of the depth limiter as well as of the cutting tooth as a consequence of the forced takealong movement of such a bow thereby preventing cutting wood in this region. This embodiment is so configured that, when the straight line portion of the guide bar is reached, the saw chain and therewith the rider returns to its original position wherein the uppermost parts of the rider lie deeper than the upper portions of the depth limiter of the cutting tooth. With this configuration, a saw chain is provided wherein the dangerous plunge-cutting work is prevented with simple means and the danger associated therewith is avoided.

The rider and the special configuration thereof which are applied in combination or independently of each other provide a saw chain wherein the operator can easily and clearly see the danger zone of the moving saw chain with the aid of simple means. In addition to the foregoing, or in the alternate, these simple means provide the chain with a contact protection which reduces the danger of injury. Independently of the foregoing, the chain can be so configured that the user receives a detectable indication directly in advance of the engagement of the cutting teeth into the wood. By means of the additional embodiments described above, the existing inclination of saw chains to kick back as well as to vibrate is reduced.

In addition, the chip removal can be favorably influenced by the configuration of the rider. Independently of this, and by appropriate configurations, the rider performs the function of a safety link and/or takes over or supplements the limitation of the cutting depth, that is, it takes over the function of a depth limiter.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven chain saw equipped with a guide bar and a drive motor for imparting a force to the saw chain for moving the latter around the guide bar in a predetermined direction F, the saw chain comprising:

a plurality of cutting links, a plurality of driving links and a plurality of connecting links, the links being pivotally interconnected by rivets to define the saw chain;

said cutting links having respective cutting teeth and said cutting teeth having respective cutting edges disposed at a pregiven elevation above the guide bar;

a plurality of non-cutting riders mounted on selected ones of said links so as to be at an elevation not extending above said elevation of said cutting edges during cutting operations of the saw chain; and, said riders having permanent marking means for producing a visible trace of the movement of the saw chain distinguishable in color from said links during non-cutting and cutting movements of the saw chain thereby visibly marking the movement of the saw chain around the guide bar.

2. The saw chain of claim 1, said selected ones of said links being connected directly ahead of said cutting links when viewed in said predetermined direction F; and, each of said riders including an attachment part for attaching the rider to the selected one of said links corresponding thereto and a movable part operatively connected to said attachment part.

3. The saw chain of claim 2, said movable part being an elongated movable part extending in a direction opposite to said predetermined direction F.

4. The saw chain of claim 3, said elongated movable part being configured so as to extend upwardly beyond said cutting edge.

5. The saw chain of claim 4, said elongated movable part being movable downwardly in a direction perpendicular to said predetermined direction F to a down position whereat said movable part is at an elevation equal to or less than said pregiven elevation when the cutting teeth cut into wood during a cutting operation.

6. The saw chain of claim 5, each of said riders having an abutment for limiting the downward movement of the elongated movable part to a predetermined elevation above the guide bar.

7. The saw chain of claim 6, said abutment being a hump-like projection formed on the attachment part of the rider.

8. The saw chain of claim 7, each of said cutting links having a depth limiter disposed ahead of the cutting tooth thereof; and, said abutment having an elevation equal to or less than the elevation of said depth limiter.

9. The saw chain of claim 6, each of said cutting links having a depth limiter disposed ahead of the cutting tooth thereof; and, said abutment and said elongated movable part together having an elevation equal to or less than the elevation of said depth limiter when said elongated movable part is moved downwardly against said abutment.

10. The saw chain of claim 3, said elongated movable part extending rearwardly up to the cutting tooth.

11. The saw chain of claim 3, each of said cutting links having a depth limiter disposed ahead of the cutting tooth thereof, the depth limiter having a pregiven elevation above said guide bar; and, said elongated movable part being disposed directly ahead of the depth limiter and being configured so as to extend above the elevation of the depth limiter.

12. The saw chain of claim 11, said elongated movable part being movable downwardly in a direction perpendicular to said predetermined direction F to a down position whereat said movable part is at an elevation equal to or less than said pregiven elevation of said depth limiter when the cutting teeth cut into wood during a cutting operation.

13. The saw chain of claim 11, said elevation of the depth limiter being the highest elevation of said depth limiter above the guide bar; and, the movable part of each rider being configured so as to have a segment thereof adjacent the depth limiter which moves into a position which does not project upwardly beyond said elevation of said depth limiter during a cutting operation of the saw chain.

14. The saw chain of claim 11, the depth limiter having a predetermined width; said movable part having a width greater than said predetermined width and having a center cutout formed therein; and, said movable part being configured so as to move into a down position during a cutting operation and said cutout accommodating the depth limiter therein when the movable part is in said down position.

15. The saw chain of claim 3, each of said cutting links having a depth limiter disposed ahead of the cutting tooth thereof, the depth limiter having a pregiven elevation above said guide bar; and, said elongated movable part being disposed directly ahead of the depth limiter and being configured to extend rearwardly up to the depth limiter.

16. The saw chain of claim 2, said movable part being movable in elevation.

17. The saw chain of claim 2, said movable part being an elongated movable part configured as a lever arm having a first end connected to said attachment part and said lever arm extending rearwardly in a direction opposite to said predetermined direction F; and, connection means for connecting said first end to said attachment part so as to permit said lever arm to move freely.

18. The saw chain of claim 2, the attachment part of each rider including first form-tight means for connecting said rider to the selected one of said links corresponding thereto; and, the selected one of said links having second form-tight means for receiving said first form-tight means therein.

19. The saw chain of claim 16, said first form-tight means being a dovetail piece and said second form-tight means being a dovetail cutout for engaging said dovetail piece.

20. The saw chain of claim 2, said rider being configured as an attachable member attachable to the selected one of said links corresponding thereto.

21. The saw chain of claim 2, said rider being configured as an insertable part insertable between two mutually adjacent ones of said links.

22. The saw chain of claim 2, further comprising snap closure means for attaching the attachment part to the selected one of the links corresponding thereto.

23. The saw chain of claim 2, further comprising press fastener means for attaching the attachment part to the selected one of the links corresponding thereto.

24. The saw chain of claim 2, each two adjacent ones of said driving links defining an intermediate space therebetween, said riders being mounted in selected ones of said intermediate spaces.

25. The saw chain of claim 2, the attachment part of each rider being configured to include pretensioning means for connecting the rider to the selected one of said links corresponding thereto.

26. The saw chain of claim 2, the driving links being center links straddled by each two mutually adjacent ones of the connecting links, the attachment part of each rider being mounted on each two mutually adjacent connecting links and having a center cutout for accommodating therein the driving links straddled by the connecting links.

27. The saw chain of claim 2, comprising dovetail connecting means at the interface of the attachment part and the connecting links.

28. The saw chain of claim 2, said attachment part including two attachment portions formed on two mutually adjacent ones of said links viewed in said predetermined direction F; and, said movable part being a bow-shaped piece having two ends connected to respective ones of said mutually adjacent links.

29. The saw chain of claim 28, wherein some of said links move radially outwardly when the saw chain moves about the outer free end of the guide bar; and, said attachment portions being formed on respective ones of the radially outwardly moving links so as to cause said bow-shaped piece to likewise move radially outwardly.

30. The saw chain of claim 29, said bow-shaped piece being movable and having a predetermined resiliency adapted to the magnitude of the cutting pressure occurring during a cutting operation.

31. The saw chain of claim 30, wherein the highest point in elevation of said bow-shaped piece is at said outer free end of the guide bar and this highest point is greater than the elevation of the cutting edge of the cutting link such that, during plunge cutting, the cutting edge comes into cutting engagement with the wood only after a predetermined thrust force is overcome.

32. The saw chain of claim 30, wherein the highest point in elevation of said bow-shaped piece is at said outer free end of the guide bar and this highest point is greater than the elevation of the depth limiter of the cutting link such that, during plunge cutting, the depth limiter comes into cutting engagement with the wood only after a predetermined thrust force is overcome.

33. The saw chain of claim 28, said bow-shaped piece being configured and dimensioned so that said bow-shaped piece takes up a thrust force during plunge cutting so as to prevent the cutting edges of the cutting links to come into cutting engagement with the wood.

34. The saw chain of claim 1, said selected ones of said links being connected ahead of said cutting links when viewed in said predetermined direction F; and, each of said riders including two attachment portions disposed at a predetermined spacing from each other and a movable bow-shaped part having two ends connected to respective ones of said attachment portions.

35. The saw chain of claim 34, said bow-shaped part being made of a resilient material.

36. The saw chain of claim 35, said resilient material being selected from the group consisting of spring steel and plastic.

37. The saw chain of claim 35, said attachment portions being configured so as to be rigid and being made of a non-elastic material.

38. The saw chain of claim 1, said riders comprising plastic and said permanent marking means being a dye for imparting a color to said plastic to provide said trace of the saw chain as the saw chain moves around the guide bar.

39. A saw chain for a motor-driven chain saw equipped with a guide bar and a drive motor for imparting a force to the saw chain for moving the latter around the guide bar in a predetermined direction F, the saw chain comprising:

a plurality of cutting links, a plurality of driving links and a plurality of connecting links, the links being pivotally interconnected by rivets to define the saw chain;

said cutting links having respective cutting teeth and said cutting teeth having respective cutting edges disposed at a pregiven elevation above the guide bar; and, a plurality of non-cutting links pivotally interconnected with the remaining ones of said links and configured so as to extend upwardly to an elevation not extending above said elevation of said cutting edges during cutting operations of the saw chain; and, said non-cutting links having permanent marking means for producing a visible trace of the movement of the saw chain distinguishable in color from said remaining links during non-cutting and cutting movements of the saw chain thereby visibly marking the movement of the saw chain around the guide bar.

40. A saw chain for a motor-driven chain saw equipped with a guide bar and a drive motor for imparting a force to the saw chain for moving the latter around the guide bar in a predetermined direction F and to enable the saw chain to cut a kerf in wood, the saw chain comprising:

a plurality of cutting links, a plurality of driving links and a plurality of connecting links, the links being pivotally interconnected by rivets to define the saw chain;

said cutting links having respective cutting teeth and said cutting teeth having respective cutting edges disposed at a pregiven elevation above the guide bar;

a plurality of non-cutting riders mounted on selected ones of said links so as to be at an elevation corresponding approximately to said elevation of said cutting teeth for visibly marking the movement of the saw chain around the guide bar;

each of said riders including an attachment part for attaching the rider to the selected one of said links corresponding thereto and a movable part having an upper portion disposed in spaced relationship to said attachment part;

hinge means for connecting said movable part to said attachment part so as to permit said movable part to move between a first position wherein said upper portion is above said elevation of said cutting teeth during non-cutting movement of the saw chain and a second position wherein said upper portion is below said elevation of said cutting teeth during cutting operations of the saw chain when the saw chain enters the kerf of the wood to be cut; and, said hinge means being resilient for resiliently biasing said movable part into said first position and for returning said movable part to said first position from said second position upon leaving the kerf.

41. The saw chain of claim 40, further comprising: permanent marking means formed in said riders for producing a visible trace of the movement of the saw chain distinguishable in color from aid links during non-cutting and cutting movements of the saw chain thereby visibly marking the movement of the saw chain around the guide bar.

42. The saw chain of claim 40, said selected ones of said links being connected directly ahead of said cutting links when viewed in said predetermined direction F.

43. The saw chain of claim 42, said movable part being an elongated movable part configured as a lever arm extending in a direction opposite to said predetermined direction F.

44. The saw chain of claim 43, said elongated movable part being configured so as to extend upwardly beyond said cutting edge.

45. The saw chain of claim 43, said elongated movable part having a length so as to cause said part to extend rearwardly to the proximity of the cutting tooth.

46. The saw chain of claim 43, each of said cutting links having a depth limiter disposed ahead of the cutting tooth thereof, the depth limiter having a pregiven elevation above said guide bar; and, said elongated movable part being disposed directly ahead of the depth limiter and being configured so as to extend above the elevation of the depth limiter.

47. The saw chain of claim 46, said elevation of the depth limiter being the highest elevation of said depth liter above the guide bar; and, the movable part of each rider being configured so as to have a segment thereof adjacent the depth limiter which moves into a position which does not project upwardly beyond said elevation of said depth limiter during a cutting operation of the saw chain.

48. The saw chain of claim 46, the depth limiter having a predetermined width; said movable part having a width greater than said predetermined width and having a center cutout formed therein; and, said movable part being configured so as to move into a down position during a cutting operation and said cutout accommodating the depth limiter therein when the movable part is in said down position.

49. The saw chain of claim 43, each of said cutting links having a depth limiter disposed ahead of the cutting tooth thereof, the depth limiter having a pregiven elevation above said guide bar; and, said elongated movable part having a length so as to cause said part to extend rearwardly to the proximity of the depth limiter.

50. The saw chain of claim 43, each of said riders having an abutment for limiting the downward movement of the elongated movable part to a predetermined elevation above the guide bar.

51. The saw chain of claim 50, said abutment having a hump-like projection formed on the attachment part of the rider.

52. The saw chain of claim 51, each of said cutting links having a depth limiter disposed ahead of the cutting tooth thereof; and, said abutment having an elevation equal to or less than the elevation of said depth limiter.

53. The saw chain of claim 50, each of said cutting links having a depth limiter disposed ahead of the cutting tooth thereof; and, said abutment and aid elongated movable part together having an elevation equal to or less than the elevation of said depth limiter when said elongated movable part is moved downwardly against said abutment.

54. The saw chain of claim 42, the attachment part of each rider including first form-tight means for connecting said rider to the selected one of said links corresponding thereto; and, the selected one of said links having second form-tight means for receiving said first form-tight means therein.

55. The saw chain of claim 54, said first form-tight means being a dovetail piece and said second form-tight means being a dovetail cutout for engaging said dovetail piece.

56. The saw chain of claim 42, said rider being configured as an attachable member attachable to the selected one of said links corresponding thereto.

57. The saw chain of claim 42, said rider being configured as an insertable part insertable between two mutually adjacent ones of said links.

58. The saw chain of claim 42, further comprising snap closure means for attaching the attachment part to the selected one of the links corresponding thereto.

59. The saw chain of claim 42, further comprising press fastener means for attaching the attachment part to the selected one of the links corresponding thereto.

60. The saw chain of claim 42, each two adjacent ones of said driving links defining an intermediate space therebetween, said riders being mounted in selected ones of said intermediate spaces.

61. The saw chain of claim 42, the attachment part of each rider being configured to include pretensioning means for connecting the rider to the selected one of said links corresponding thereto.

62. The saw chain of claim 40, the driving links being center links straddled by each two mutually adjacent ones of the connecting links, the attachment parts of each rider being mounted on each two mutually adjacent connecting links and having a center cutout for accommodating therein the driving links straddled by the connecting links.

63. The saw chain of claim 62, comprising dovetail connecting means at the interface of the attachment part and the connecting links.

64. The saw chain of claim 40, said riders comprising plastic and said permanent marking means being a dye for imparting a color to said plastic to provide said trace of the saw chain as to saw chain moves around the guide bar.

65. A saw chain for a motor-driven chain saw equipped with a guide bar and a drive motor for imparting a force to the saw chain for moving the latter around the guide bar in a predetermined direction F and to enable the saw chain to cut a kerf in wood, the saw chain comprising:

a plurality of cutting links, a plurality of driving links and a plurality of connecting links, the links being pivotally interconnected by rivets to define the saw chain;

said cutting links having respective cutting teeth and said cutting teeth having respective cutting edges disposed at a pregiven elevation above the guide bar;

a plurality of non-cutting links pivotally interconnected with the remaining ones of said links in each of said non-cutting links having a base part and a movable part extending upwardly from said base part to an elevation corresponding approximately to said elevation of said cutting teeth for visibly marking the movement of the saw chain around the guide bar;

each of said movable parts having an upper portion disposed in spaced relationship to the base part corresponding thereto;

hinge means for connecting said movable part to said base part so as to permit said movable part to move between a first position wherein said upper portion is above said elevation of said cutting teeth during non-cutting movement of the saw chain and a second position wherein said upper portion is below said elevation of said cutting teeth during cutting operations of the saw chain when the saw chain enters the kerf of the wood to be cut; and, said hinge means being resilient for resiliently biasing said movable part into said first position and for returning said movable part to said first position from said second position upon leaving the kerf.

66. The saw chain of claim 65, further comprising: permanent marking means formed in said non-cutting links for producing a visible trace of the movement of the saw chain distinguishable in color from said remaining links during non-cutting and cutting movements of the saw chain thereby visibly marking the movement of the saw chain around the guide bar.

* * * * *

UNITED STATES PATENT AND TRADEMARK OFFICE

CERTIFICATE OF CORRECTION

PATENT NO. : 5,042,350

DATED : August 27, 1991

INVENTOR(S) : Karl Nitschmann

It is certified that error appears in the above-identified patent and that said Letters Patent is hereby corrected as shown below:

In column 3, line 29: delete "./,".

In column 8, line 19: delete "ban" and substitute -- bar -- therefor.

In column 15, line 13: delete "aid" and substitute -- said -- therefor.

In column 15, line 39: delete "liter" and substitute -- limiter -- therefor.

In column 15, line 63: delete "having" and substitute -- being -- therefor.

In column 16, line 5: delete "aid" and substitute -- said -- therefor.

Signed and Sealed this

Twenty-seventh Day of April, 1993

*Attest:*

MICHAEL K. KIRK

*Attesting Officer*

*Acting Commissioner of Patents and Trademarks*